US006049277A

United States Patent [19]

Osame

[11] Patent Number: 6,049,277

[45] Date of Patent: Apr. 11, 2000

[54] ALARM DEVICE

[76] Inventor: Mitsuo Osame, 4-7-12-203, Chiyoda, Sakado, Saitama, 350-0214, Japan

[21] Appl. No.: 09/289,184

[22] Filed: Apr. 9, 1999

[30] Foreign Application Priority Data

Apr. 9, 1998 [JP] Japan ..... 10-003354 U
Jun. 12, 1998 [JP] Japan ..... 10-165513

[51] Int. Cl.[7] ..... G08B 13/14

[52] U.S. Cl. ..... 340/568.7; 340/571

[58] Field of Search ..... 340/568.7, 571; 200/61.19

[56] References Cited

U.S. PATENT DOCUMENTS

| | | | |
|---|---|---|---|
| 3,815,118 | 6/1974 | McDonald | 340/571 |
| 3,851,326 | 11/1974 | Costa | 340/571 |
| 3,938,126 | 2/1976 | Ransom | 340/571 |
| 4,090,183 | 5/1978 | Miller | 340/571 |
| 4,633,232 | 12/1986 | Nelson et al. | 340/571 X |
| 4,908,607 | 3/1990 | Yannotti et al. | 340/571 |
| 5,396,219 | 3/1995 | Chen | 340/571 |
| 5,790,028 | 8/1998 | Lee | 340/571 |

FOREIGN PATENT DOCUMENTS

| | | |
|---|---|---|
| 55-143015 | 11/1980 | Japan . |
| 1-138194 | 5/1989 | Japan . |

*Primary Examiner*—Thomas Mullen
*Attorney, Agent, or Firm*—Smith, Gambrell & Russell, LLP

[57] ABSTRACT

An antitheft alarm device has an electric circuit 21 for generation of an audible alarm and a supporting mechanism 42 for a flexible cord 6 formed between an upper and lower face plates 2, 3. The circuit 21 has a switch 26 comprising a stationary terminal 35 and a movable terminal 34 biased by a spring to be engaged with the stationary terminal 35. The flexible cord 6 detachably held by the mechanism 42 normally maintains the movable terminal 34 to be disengaged with the stationary terminal 35. After the cord 6 is detached, the movable terminal 34 engages with the stationary terminal 35 and consequently the audible alarm is generated.

6 Claims, 3 Drawing Sheets

ALARM DEVICE

BACKGROUND OF THE INVENTION

This invention relates to a portable antitheft alarm device for a purse and the like carried by a user of this device.

Japanese Utility Model Application Laid-open No. 1980-143015 describes a credit card case provided with an alarm device which comprises an audible alarm generating circuit including a battery and a switch. The switch is opened as a credit card is inserted into the case and the switch is closed to generate the audible alarm as this card is stolen from the case.

Japanese Utility Model Application Laid-open No. 1989-138194 describes an antitheft alarm device adapted to generate an audible alarm as a cord connected to the device is cut off.

The device described in the Japanese Utility Model Application Laid-open No. 1980-143015 is certainly effective to prevent individual credit cards from being stolen. However, this device can not serve as a means to prevent the card case itself from being stolen together with the credit cards contained therein.

The device described in the Japanese Utility Model Application Laid-open No. 1989-138194 is not suitable to be used with a relatively small and light article such as a credit card or a credit card case.

SUMMARY OF THE INVENTION

In view of the problems as have been described above, it is a principal object of the invention to provide a portable antitheft alarm device suitable to be used with a relatively small and light article such as a purse or a credit card case usually carried by a user.

The object set forth above is achieved, according to the invention, by an alarm device comprising a combination of a main body and a flexible cord, the alarm device being characterized by that: the main body comprises a pair of face plates extending in parallel to each other, an electric circuit for generation of audible alarm including a power source and an on/off switch, the electric circuit being arranged in a cavity formed between the pair of the face plates, and a supporting mechanism for detachably holding the flexible cord inserted into a gap defined between the pair of the face plates, wherein an electric contact means of the on/off switch comprises a movable terminal normally biased by a spring means and a stationary terminal with which the movable terminal can be detachably engaged so that the audible alarm is generated when the movable and stationary terminals are engaged with each other under the biasing force of the spring means and the electric circuit is closed, on one hand, and the generation of the audible alarm ceases when the flexible cord is engaged directly or indirectly via an interposed member with the movable terminal and consequently the movable terminal is disengaged from the stationary terminal against the biasing force of the spring means, on the other hand.

Preferably, the pair of the face plates are substantially same sized rectangular plates and placed one upon another so that with transversely opposite lateral surfaces as well as longitudinally opposite end surfaces of the upper face plate are vertically aligned with and spaced from the associated ones of the lower face plate by a distance enough to introduce the flexible cord extending along the lateral or end surface into a gap defined between the pair of the face plates until the flexible cord is received in the supporting mechanism.

Preferably, the flexible cord has a length enough to assure that at least one end thereof can extend outward from the periphery of the pair of the face plates after the flexible cord has been received in the supporting mechanism.

Preferably, the pair of the face plates are formed substantially in a same size as a credit card.

Preferably, the device represents an external shape being substantially same as the credit card.

Preferably, a battery used as the power source is exchangeable.

Preferably, the movable terminal can be disengaged from the stationary terminal not only by means of the flexible cord but also by means of measures other than the flexible cord.

DESCRIPTION OF THE PREFERRED EMBODIMENTS

Details of an alarm device according to the invention will be more fully understood from the description given hereunder in reference with the accompanying drawings.

Figure 1:
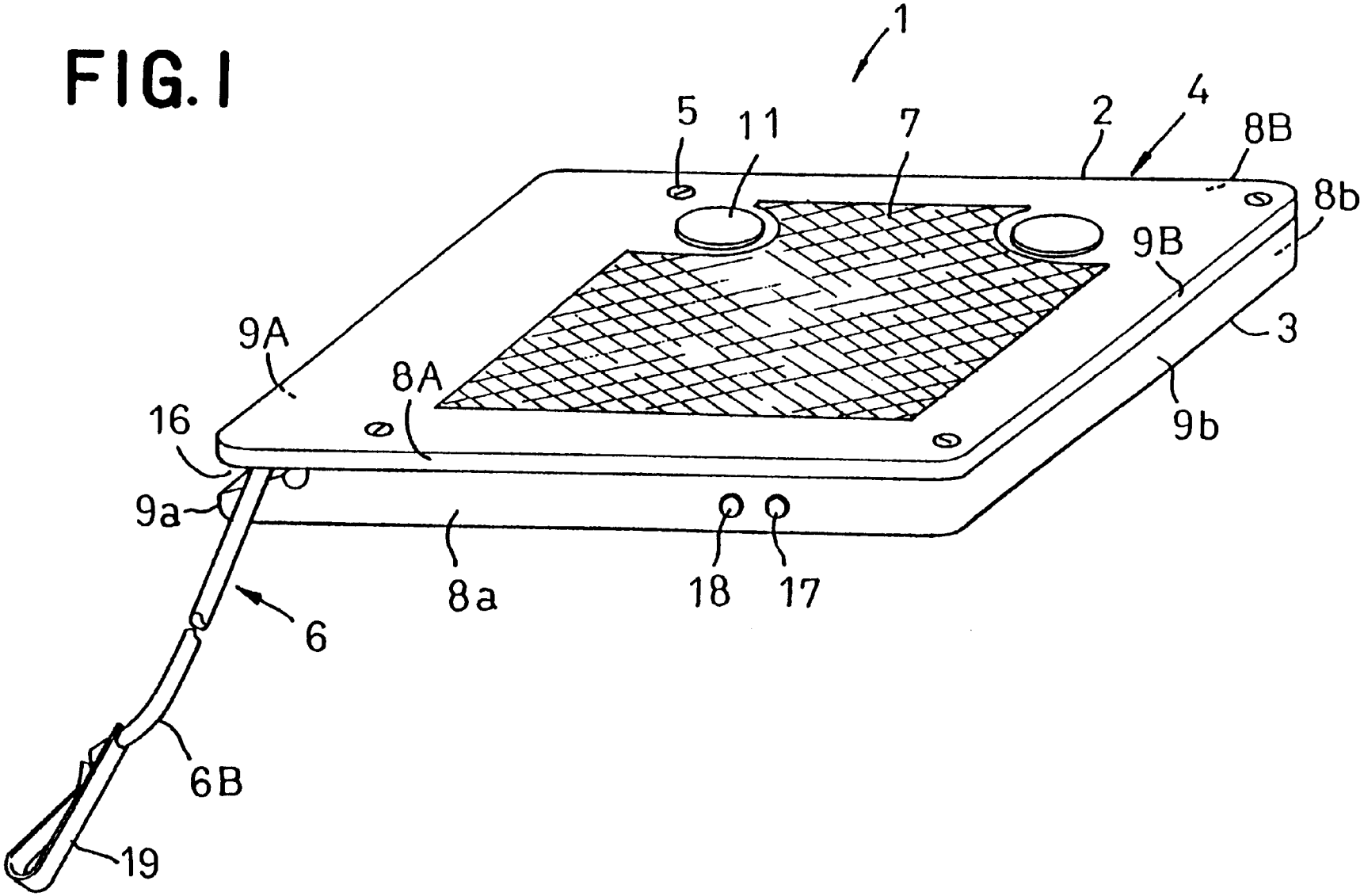
FIG. 1 is a perspective view showing an alarm device according to the invention.

An alarm device 1 shown by FIG. 1 in a perspective view is substantially rectangular in a form as well as in a size of a credit card. The device 1 comprises a main body 4 having a thickness of 2~5 mm and a flexible cord 6 separably engaged with the main body 4.

The main body 4 has an upper face plate 2 and a lower face plate 3, both being substantially of a same size and secured together at their four corners by means of screws 5. An upper face plate 2 is preferably made of electrically non-conductive material and has a pair of transversely opposite surfaces 8A, 8B extending in parallel to each other and a pair of longitudinally opposite end surfaces 9A, 9B extending in parallel to each other. The upper face plate 2 is partially engraved on its top surface with a checker pattern 7 and carries thereon circular rubber pads 11. Both the checker pattern 7 and the rubber pads 10 frictionally prevent the device 1 from slipping out of a purse into which the device is inserted. The lower face plate 3 is also preferably made of electrically non-conductive material and has an outer surface similar to that of the upper face plate 2. The lower face plate 3 has lateral surfaces 8*a*, 8*b* and end surfaces 9*a*, 9*b* corresponding to the lateral surfaces 8A, 8B and the end surfaces 9A, 9B, respectively, of the upper face plate 2. The lateral surfaces 8*a*, 8*b* and the end surfaces 9*b* have the same height but the end surface 9*a* has a relatively small height. The end surfaces 9A, 9B of the upper and lower face plates 2, 3 define therebetween a groove 16 opening laterally of the main body 4. A light emitting diode 17 for checking a life of a source battery and a push-button 18 are exposed on the lateral surface 8*a* of the lower face plate 3.

The cord 6 is preferably made of electrically non-conductive material having a portion 6A (FIG. 2) which is extending within the main body 4 along the groove 16 and a remaining portion 6B which is extending outward from the groove 16. The portion 6B is provided with a hook member 19.

Figure 2:
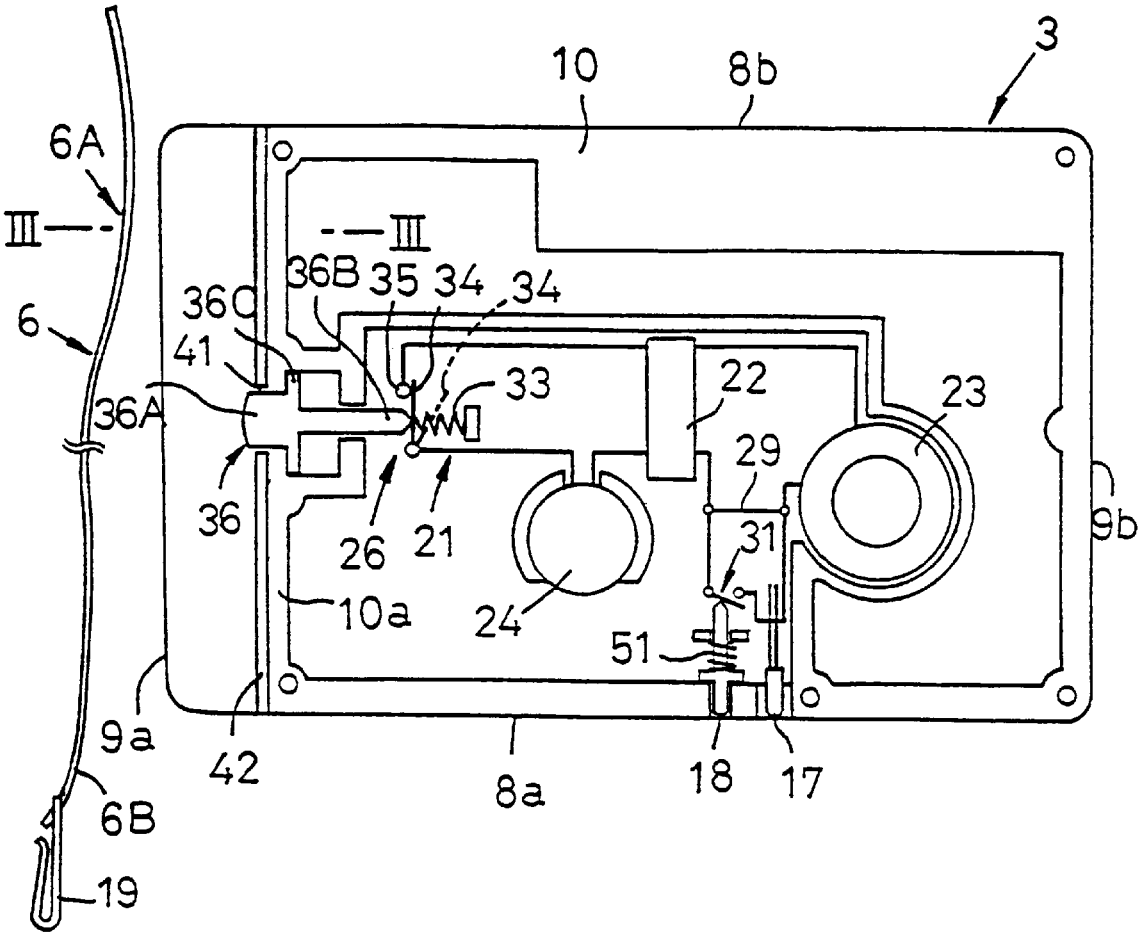
FIG. 2 is a plan view showing the interior of the alarm device.

FIG. 2 is a plan view of the device 1 previously shown by FIG. 1 as the upper face plate 2 as well as the cord have been disengaged from the device 1, separately showing the main body 4 and the cord 6.

Figure 3:
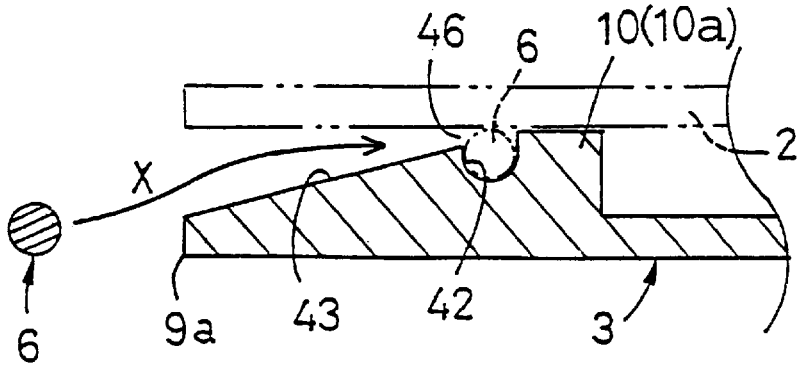
FIG. 3 is a sectional view taken along a line III—III in FIG. 2.

FIG. 3 is a sectional view taken along a line III—III in FIG. 2.

Figure 4:
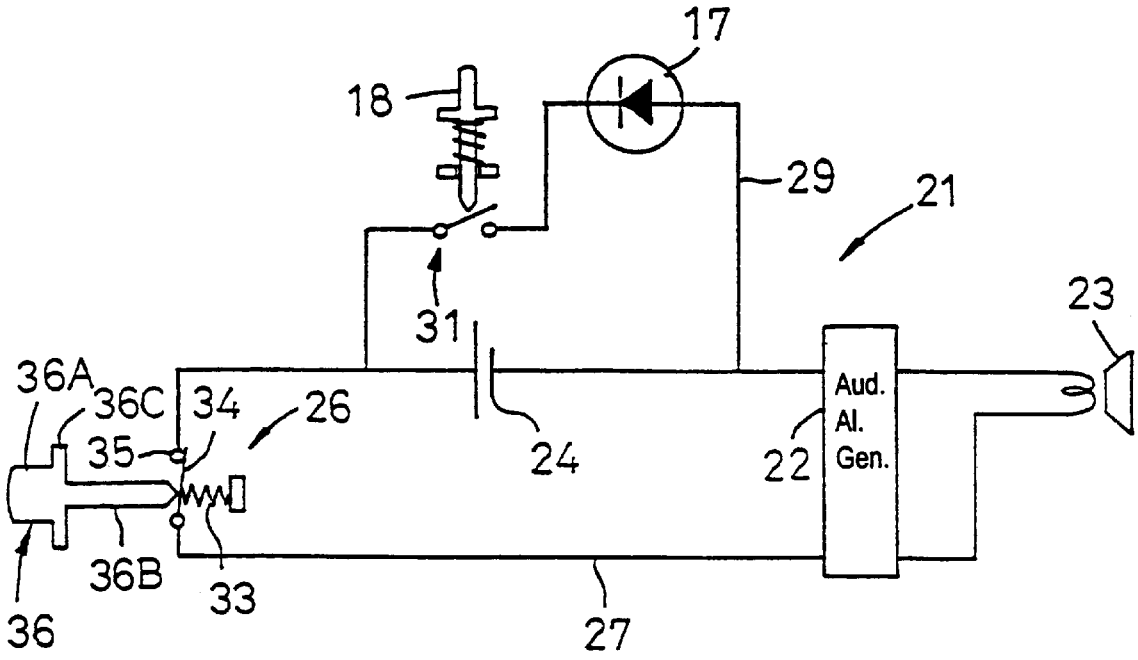
FIG. 4 is a circuit diagram illustrating an electric circuitry incorporated in the alarm device.

FIG. 4 is a circuit diagram illustrating an electric circuitry 21 incorporated in the main body 4 to generate an audible alarm. The lower face plate 3 has on its inner surface a rib 10 extending continuously along the lateral surfaces 8*a*, 8*b* and the end surfaces 9*a*, 9*b* wherein the rib 10 is contiguous to the surfaces 8*a*, 8*b* and 9*b* but is lying away from the end surface 9*a* located at the left hand in FIG. 2. The electric circuitry 21 and the other components are arranged within a recess surrounded by the rib 10. A part 10*a* of the rib 10 extending in parallel to the end surface 9*a* has a cut-out 41 through which a recess communicates with the interior and exterior of the main body 4 and a cord receiving groove 42 extending outside the part 10*a* between the lateral surfaces 8*a*, 8*b*. As will be apparent from FIG. 3, the lower face plate 3 has a sloped surface 43 extending upward from the end surface 9*a* to the cord receiving groove 42. In FIG. 3, the upper face plate 2 and the cord 6 received in the groove 42 are indicated by imaginary lines.

The electric circuitry 21 incorporated in the main body 4 comprises an audible alarm generator 22, a speaker 23, a source battery 24 and an on/off switch 26 all of which are electrically connected by a conductor 27 one to another. The circuitry 21 further includes a battery life check circuit 29. The circuit 29 comprises a switch 31 in addition to the previously mentioned light emitting diode 17 and push-button 18. The circuitry 21 is so arranged that the audible alarm generator 22 is energized to generate the audible alarm from the speaker 23 when the switch 26 is closed and deenergized to stop the alarm generation when the switch 26 is opened. Contact means for the switch 26 comprise a movable terminal 34 normally biased by a spring 33 to close the switch 26, a stationary terminal 35 with which the terminal 34 can detachably come in contact and an actuator 36 which is outwardly bearing against the movable terminal 34 and biased by the spring 33 outwardly of the lower face plate 3. The actuator 36 is made of electrically non-conductive material and has an outer end portion 36A extending outward of the lower face plate 3, an inner end portion 36B extending inwardly of the lower face plate 3 and a pair of wing portions 36C transversely extending from the actuator 36 at an intermediate portion between the outer and inner end portions 36A, 36B. In a state shown by FIG. 2, the outer end portion 36A extends outward beyond the rib 10*a* so as to lie in or outside the cord receiving groove 42 and the inner end portion 36B is bearing against the movable terminal 34. The pair of the wing portions 36C can bear against the inner wall of the rib 10 in the proximity of the cut-out 41 thereof so as to keep the actuator 36 inside of the rib 10*a*. The upper face plate 2 may be detached from the main body 4 for exchange of the battery 24.

The check circuit 29 is so arranged that, upon depression of the pushbutton 18 exposed through the lateral surface 8*a*, the switch 31 is closed and, if the battery 24 is still not exhausted, the diode 17 turns on a light. The pushbutton 18 is normally biased by a spring 51. If the invention is implemented in the form of the device which requires no check of the battery 24, the circuit 29 may be eliminated.

The cord 6 is longer than the length of the end surface 9*a* of the lower face plate 3 and has a diameter so dimensioned that, as shown in FIG. 3, the cord 6 can be introduced along an arrow X into a gap 46 between the top of the sloped surface 43 and the upper face plate 2, then pressed into the cord receiving groove 42 in which the cord 6 is closely in contact with the upper and lower face plates 2, 3. Having been received in the groove 42, the cord 6 pushes the actuator 36 at the outer end portion 36A and the actuator 36 causes the movable terminal 34 to move against the biasing force of the spring 33, as indicated by an imaginary line in FIG. 2, thus opening the switch 26. As long as the switch 26 is in its opened state, the device 1 generates no audible alarm. When a pulling force is exerted on the cord 6 received in the groove 42, the cord 6 is detached from the groove 42 either transversely of the groove 42, i.e., transversely of the gap 46 or pulled out longitudinally of the groove 42.

The device 1 as has been described above may be put into a purse or a wallet with the cord 6 of which the portion 6A is detachably held in the groove 42 and the hook 19 of the cord 6 is fastened to user's clothes or the like. If the purse or wallet containing therein the device 1 is picked from a user's pocket and brought away from the user's body, the cord 6 will be pulled and detached from the groove 42 of the main body 4. Thereupon, the actuator 36 is released from the restriction by the cord 6 and thereby allows the movable terminal 34 to move under the biasing force of the spring 33. Consequently the switch 26 is closed and the audible alarm is generated. To stop generation of the audible alarm, the cord 6 may be pressed again into the groove 42. Aside the the main body 4 may be provided with a slide button or the like to stop the audible alarm. The slide button may be slidably moved until it bears against the movable terminal 34 and the button may be further moved so as to separate the terminal 34 from the stationary terminal 35. The slide button can stop the audible alarm generated after the cord 6 is detached.

In view of the fact that the main body 4 of the device 1 is connected to the user's clothes or the like by means of the flexible cord 6, the main body 4, in other words, a purse or wallet containing therein this main body 4, is substantially free from restriction by the cord 6 in a user's pocket. Additionally, the cord 6 is readily detached from the main body 4 regardless of the direction in which the main body 4 moves in the pocket. In this manner, the device 1 is very convenient to carry, as the orientation of the device 1 in the pocket is not important.

The checker pattern 7 and the rubber pads 10 provided on the surface of the main body 4 serve to increase a frictional force between the main body 4 and the purse or wallet and facilitate the main body 4 to remain in the purse or wallet even when the purse or wallet is being picked from the pocket.

Should the main body 4 be slippery within the purse or wallet or should the cord 6 be not readily detached from the main body 4, the device 1 might disadvantageously fall out of the purse or wallet before the cord 6 is detached from the main body 4. It should be understood that the invention may be implemented in the form of the device 1 having neither the checker pattern 7 nor the rubber pads 10 on the main body 4 so far as these components are initially considered to be unnecessary for a specific embodiment. It is also possible to provide the main body 4 with a hook member or the like by means of which the main body 4 is fixed to the purse or wallet.

Figure 5:
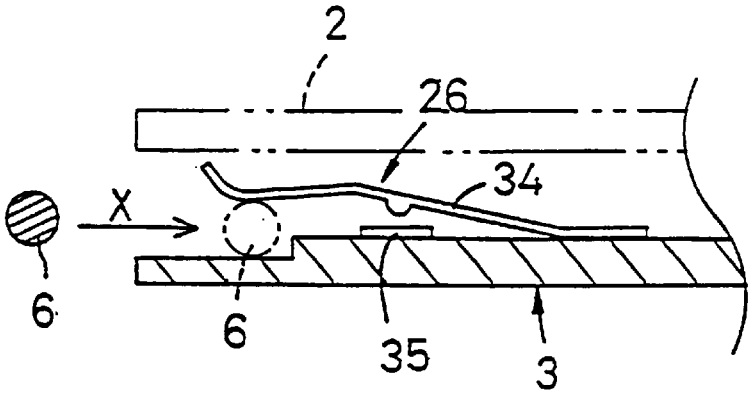
FIG. 5 is a view similar to FIG. 2 showing an alternative embodiment of the invention.

FIG. 5 is a view similar to FIG. 3 showing another embodiment of the invention. In the case of this device 1, the contact means of the switch 26 comprises the stationary terminal 35 and the movable terminal 34 in a form of a leaf spring adapted to come in contact with the stationary terminal 35 under its own elasticity. As indicated by imaginary lines, the cord 6 may be inserted along an arrow X between the movable terminal 34 and the stationary terminal 35 to open the switch 26. Inversely, removing the cord 6 from its position causes the movable terminal 34 to come in contact with the stationary terminal 35 and thereby to close the switch 26, whereupon the audible alarm is generated.

Without departing from the scope of the invention, an appropriate mechanism other than the cord receiving groove 42 may be adopted to detachably hold the cord 6 within the main body 4. For example, the cord 6 may be detachably held within the main body 4 by pinching the cord 6 between the movable terminal 34 and the stationary terminal 35 as in the case of the embodiment illustrated by FIG. 5. It is also possible to provide the cord 6 with an appropriate non-conductive member by means of which the movable terminal 34 is moved.

The alarm device according to the invention can be put in a purse, a wallet or a credit card case and generates audible alarm if the purse or the like is picked from a user's pocket and brought away from the user's body. Accordingly, the device can offer a reliable antitheft effect for a purse, wallet or credit card case.

Such an alarm device is featured in that the main body thereof is connected to user's clothes or the like by means of a flexible cord. This feature makes the device very convenient to carry, as any specific orientation of the main body within the purse or the like is not essential for the device to work and the cord is readily detached from the main body regardless of a direction in which the main body is oriented.

What is claimed is:

1. An alarm device comprising a combination of a main body and a flexible cord, the alarm device being characterized by that: the main body comprises a pair of face plates extending in parallel to each other, an electric circuit for generation of audible alarm including a power source and an on/off switch, said electric circuit being arranged in a cavity formed between the pair of the face plates, and a supporting mechanism for detachably holding the flexible cord inserted into a gap defined between the pair of the face plates, wherein electric contact means of the on/off switch comprise a movable terminal normally biased by a spring and a stationary terminal with which the movable terminal is detachably engaged so that an audible alarm is generated when the movable and stationary terminals are engaged with each other under a biasing force of the spring and the electric circuit is closed, on one hand, and generation of the audible alarm ceases when the flexible cord is engaged directly or indirectly via an interposed member with the movable terminal and consequently the movable terminal is disengaged from the stationary terminal against the biasing force of the spring, on the other hand.

2. The device according to claim 1, wherein the pair of the face plates are substantially same sized rectangular plates and placed one upon another so that transversely opposite lateral surfaces as well as longitudinally opposite end surfaces of the upper face plate are vertically aligned with and spaced from the associated ones of the lower face plate by a distance enough to introduce the flexible cord extending along the lateral or end surfaces into the gap defined between the pair of the plates until the flexible cord is received in the supporting mechanism.

3. The device according to claim 1, wherein the flexible cord has a length enough to assure that at least one end thereof can extend outward through the gap between the pair of the face plates after the flexible cord has been received in the supporting mechanism.

4. The device according to claim 1, wherein the pair of the face plates are formed substantially in a same size as a credit card.

5. The device according to claim 1, wherein the device has an external shape being substantially the same as a credit card.

6. The device according to claim 1, wherein a battery used as the power source is exchangeable.

* * * * *